US010398008B2

(12) United States Patent
Tang et al.

(10) Patent No.: US 10,398,008 B2
(45) Date of Patent: Aug. 27, 2019

(54) LIGHT ASSEMBLY

(71) Applicants: Yi-Wen Tang, Taichung (TW); Shun-Li Yang, Xiamen (CN)

(72) Inventors: Yi-Wen Tang, Taichung (TW); Shun-Li Yang, Xiamen (CN)

( * ) Notice: Subject to any disclaimer, the term of this patent is extended or adjusted under 35 U.S.C. 154(b) by 0 days.

(21) Appl. No.: 15/862,622

(22) Filed: Jan. 4, 2018

(65) Prior Publication Data

US 2019/0208606 A1 Jul. 4, 2019

(51) Int. Cl.

| | |
|---|---|
| ***H05B 37/02*** | (2006.01) |
| ***F21S 2/00*** | (2016.01) |
| ***F21V 23/00*** | (2015.01) |
| ***F21S 4/28*** | (2016.01) |
| ***F21V 15/01*** | (2006.01) |
| ***F21Y 103/00*** | (2016.01) |

(52) U.S. Cl.

CPC ..... *H05B 37/0272* (2013.01); *F21S 2/005* (2013.01); *F21S 4/28* (2016.01); *F21V 15/01* (2013.01); *F21V 23/007* (2013.01); *F21Y 2103/00* (2013.01)

(58) Field of Classification Search

CPC . F21S 4/20–28; F21S 2/00–005; F21K 9/235; F21K 9/272; F21K 9/275; F21K 9/27; H05B 37/0272; H05B 37/036; F21V 15/015; F21V 15/01; F21V 21/005; F21V 21/06; F21V 23/06; F21V 23/001; F21V 23/002; F21Y 2103/10

See application file for complete search history.

(56) References Cited

U.S. PATENT DOCUMENTS

| | | | | |
|---|---|---|---|---|
| 8,232,724 | B2 * | 7/2012 | Mostoller | F21S 8/031 313/512 |
| 8,419,223 | B2 * | 4/2013 | Withers | F21S 2/00 362/254 |
| 2012/0201021 | A1 * | 8/2012 | Todd | F21S 2/005 362/217.02 |
| 2013/0033195 | A1 * | 2/2013 | Liao | F21S 9/032 315/294 |
| 2013/0141890 | A1 * | 6/2013 | Carlin | F21V 23/026 362/20 |
| 2013/0331038 | A1 * | 12/2013 | Kusakari | H04B 1/03 455/66.1 |
| 2014/0036505 | A1 * | 2/2014 | Barton | F21V 21/005 361/249.06 |
| 2014/0043802 | A1 * | 2/2014 | Dings | F21S 2/005 362/221 |
| 2016/0116143 | A1 * | 4/2016 | Li | F21V 15/015 362/219 |
| 2016/0369950 | A1 * | 12/2016 | Yeager | F21V 3/02 |
| 2017/0244148 | A1 * | 8/2017 | Ge | F21V 23/00 |

* cited by examiner

*Primary Examiner* — Mariceli Santiago

(57) ABSTRACT

A light assembly includes multiple first units and multiple controller members. Each first unit has multiple light members received therein. Each first unit has two control members connected to two ends thereof. The control members and the power source is electrically connected wirelessly so that the control members controls the operation of the light members. Two control members communicate with each other by a common frequency. Multiple light assemblies are electrically connected to each other by the control members using the common frequency.

12 Claims, 9 Drawing Sheets

LIGHT ASSEMBLY

BACKGROUND OF THE INVENTION

1. Fields of the Invention

The present invention relates to a light assembly, and more particularly, to a light assembly that includes two control members, and multiple light assemblies are controlled by wireless singles via the control members.

2. Descriptions of Related Art

The conventional light assembly is disclosed in FIG. 9, and comprises multiple light tubes 81 and each light tube 81 includes a fifth plugs on each of two ends thereof. A sixth plug is located beside the fifth plug corresponding thereto. Multiple second power cables 82 are respectively connected to the sixth plugs of the multiple light tubes 81, and the second power cables 82 are connected with a power source so as to provide electric power to activate the light tubes 81. A second connection cable 83 is connected two respective fifth plugs of two light tubes 81 so that the light tubes 81 are activated simultaneously.

It is noted that all of the light tubes 81 have to be connected to the second power cables 82 and the second connection cable 83 so as to be turned on and turned off simultaneously. The length of each of the second power cables 82 and each of the second connection cable 83 restricts the locations of the light tubes 81. The second power cables 82 and the second connection cable 83 also make the light assembly to be mess and not organized.

The present invention intends to provide a light assembly that includes multiple light units, and the light units are controlled by wireless signals to eliminate the shortcomings mentioned above.

SUMMARY OF THE INVENTION

The present invention relates to a light assembly which comprises multiple first units and multiple controller members. Each first unit has multiple light members received therein. Each first unit has two control members connected to two ends thereof. The control members and the power source is electrically connected wirelessly so that the control members controls the operation of the light members. Two control members communicate with each other by a common frequency. Multiple light assemblies are electrically connected to each other by the control members using the common frequency.

The advantages of the present invention are that the control members and the power source is electrically connected wirelessly so that the control members controls the operation of the light members. The control members communicate with each other by a common frequency. The control members control the light members to be turned on or turned off simultaneously. Multiple light assemblies are electrically connected to each other by the control members using the common frequency. The light assemblies are arranged without worry of the length of power cables and connection cables.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
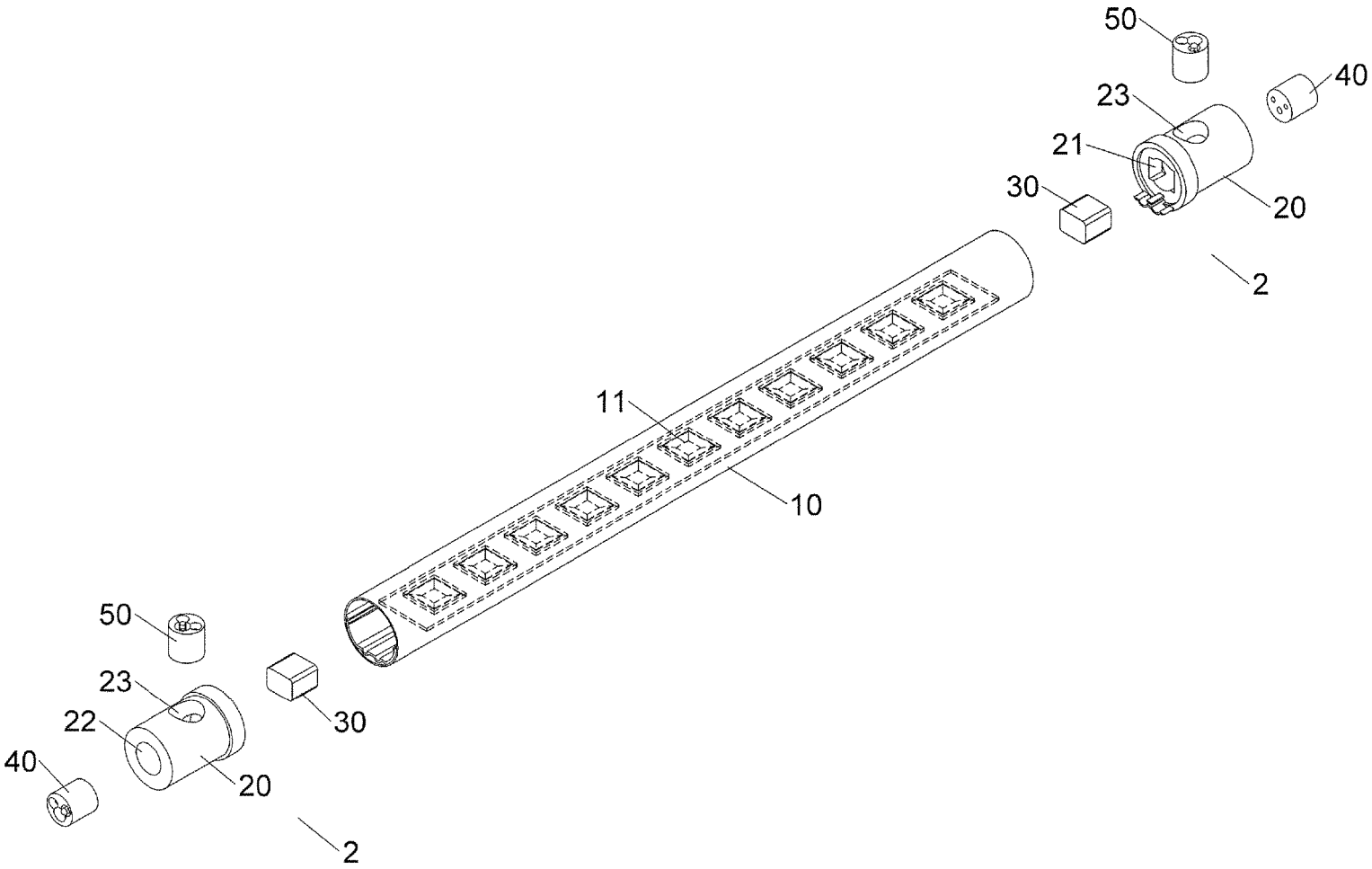
FIG. 1 is an exploded view of the light assembly of the present invention.
Figure 2:
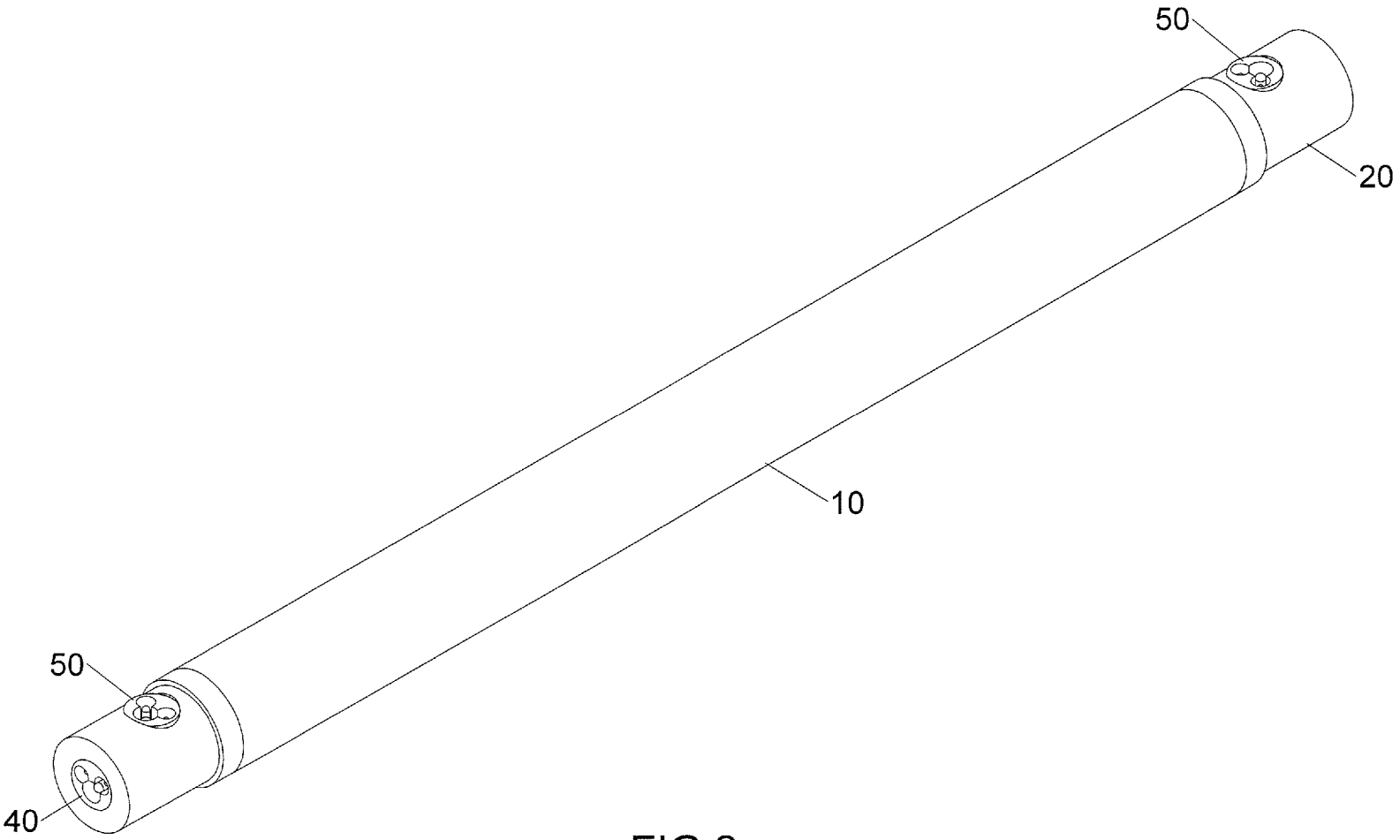
FIG. 2 is a perspective view to show the light assembly of the present invention.
Figure 3:
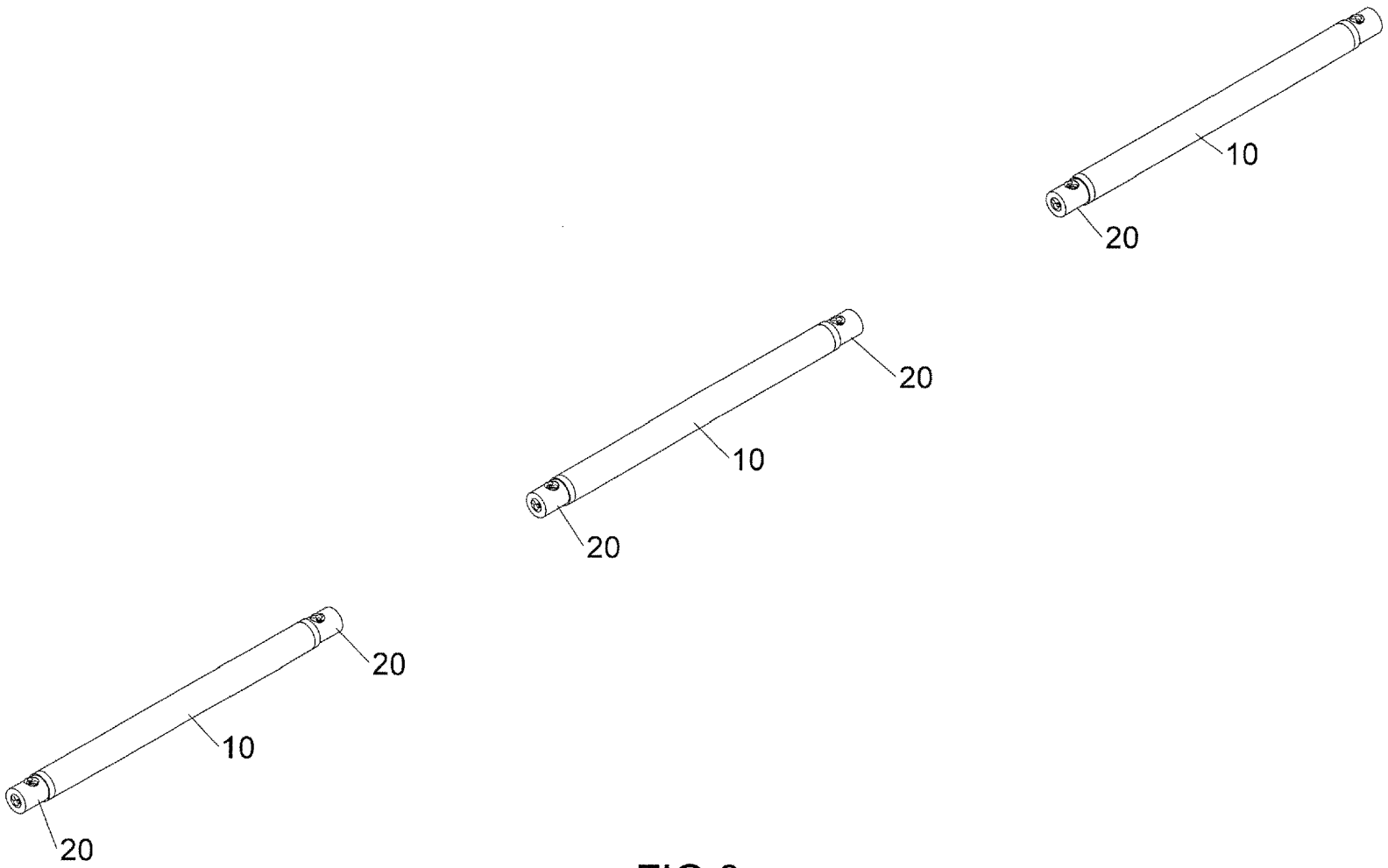
FIG. 3 shows multiple light assemblies are arranged without cables connected therebetween.

Referring to FIGS. 1 to 5, the light assembly of the present invention comprises multiple first units 10 each have multiple light members 11 received therein. The first units 10 each are a cylindrical transparent or translucent unit, and the light members 11 emit light beams which pass through the first units 10.

Two second units 2 are respectively connected to two ends of each of the first units 10 so as to seal the two ends of the first unit 10. Each second unit 2 includes an end member 20, a first control member 30, a second plug 40 and a third plug 50. The end member 20 is a cylindrical member and mounted to the first unit 10 corresponding thereto. At least one seal ring is located between the end member 20 and each of the two ends of the first unit 10 so as to be water-tight.

For each second unit 2, the end member 20 has a first room 21 and a second room 22 respectively defined in two ends thereof. The first room 21 is a rectangular recess and communicates with the second room 22 which is a cylindrical recess. The end member 20 further has a third room 23 defined radially therein, and the third room 23 communicates with the first room 21 and the second room 22. The axis of the third room 23 is perpendicular to the axis of the second room 22. The third room 23 is a cylindrical recess.

The first control member 30 is received in the first room 21 of the end member 20 and can be charged by a power source by wireless way. The first control member 30 partially protrudes beyond the first room 21 of the end member 20. The first control member 30 provides power to the light members 11 so as to turn on or turn off the light members 11 simultaneously. The first control member 30 is electrically connected to the light members 11 by wireless way of wired way. It is noted that the multiple first control members 30 are electrically connected to each other wirelessly by using a common frequency so as to control the multiple first units 10. In this embodiment, the common frequency is 433.2 MHZ.

The second plug 40 is received in the second room 22 of the end member corresponding thereto. The second plug 40 electrically connected to the first control member 30 by wireless way or by wired way. In this embodiment, the second plug 40 is a female plug which can be any female plug in the market.

The third plug 50 is located in the third room 23 of the end member 20 and is electrically connected to the first control member 30 by wireless way of by wired way. The third plug 50 is a female plug which can be any female plug in the market.

Multiple light assemblies are electrically connected to each other by the first control members 30 using the common frequency. Each first control member 30 can control the light members 11 to be turned on or turned off simultaneously.

Figure 4:
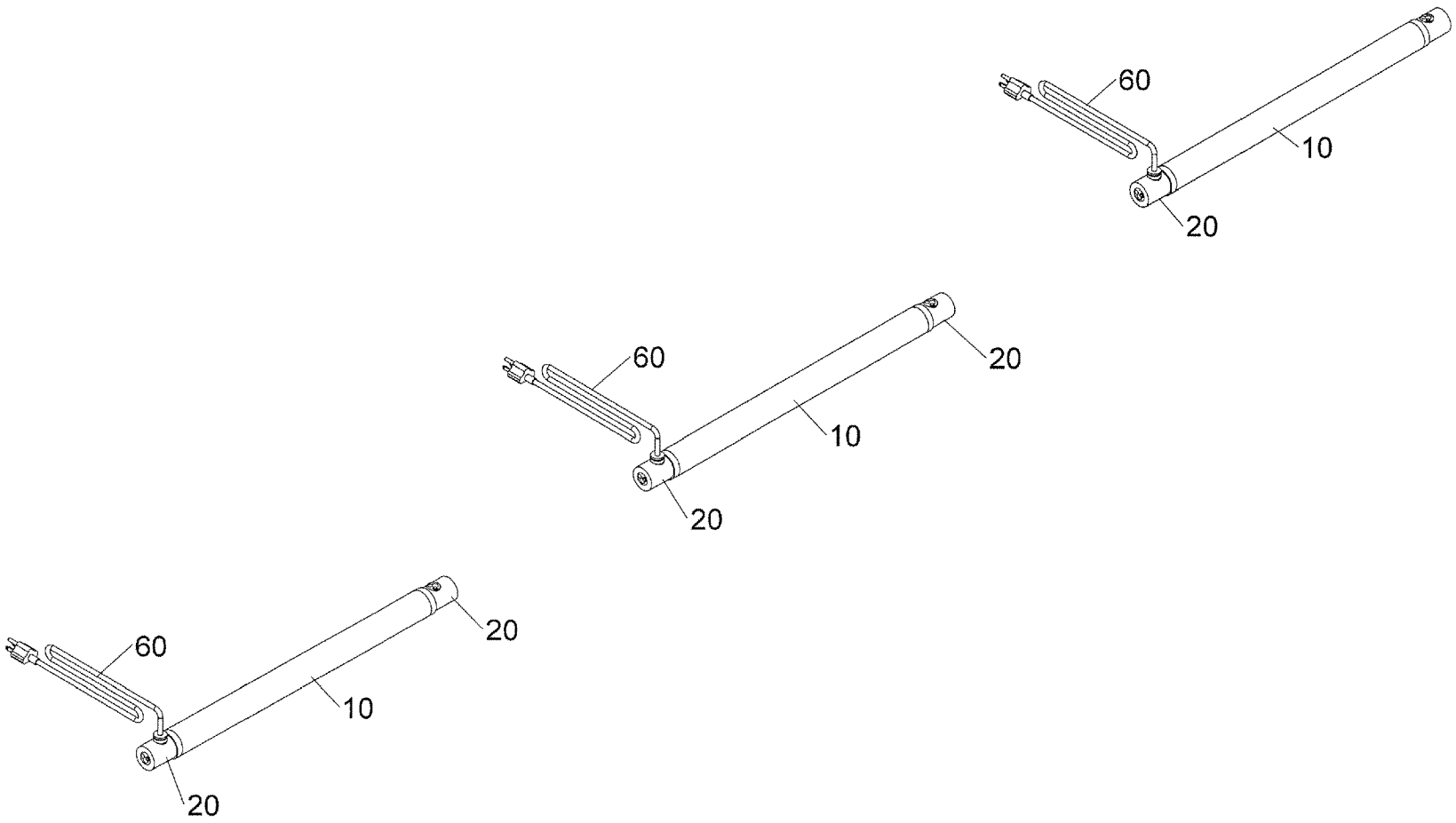
FIG. 4 shows that each light assembly of the present invention is connected to a first power cable.

As shown in FIG. 4, a first power cable 60 is connected between the third plug 50 and the power source so as to provide electric power to the light members 11. Multiple light assemblies are electrically connected to each other by the first control members 30 using the common frequency. Each first control member 30 can control the light members 11 to be turned on or turned off simultaneously.

Figure 5:
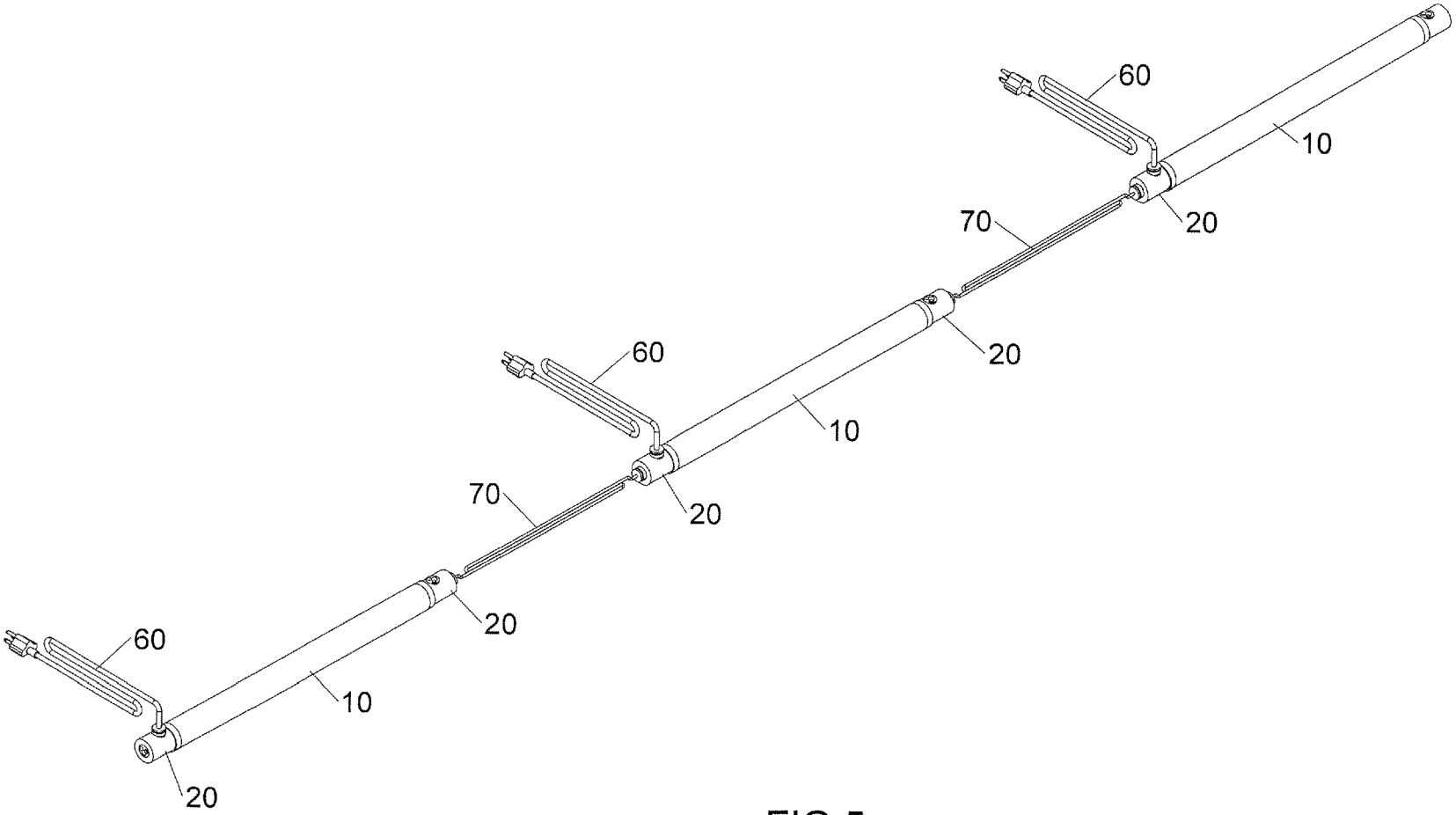
FIG. 5 shows that connection cables are connected between the light assemblies of the present invention as shown in FIG. 4.

As shown in FIG. 5, a first connection cable 70 is connected between two respective second plugs 40 of two light assemblies. That is to say, the connection cable 70 has one end connected to the second plug 40 of one light assembly, and the other end of the connection cable 70 is connected to another second plug 40 of another light assembly. The first power cable 60 has one end connected to the third plug 50, and the other end of the first power cable 60 has a plug which is connected to the power source, so that the first power cable 60 provides electrical power to the light members 11.

Figure 6:
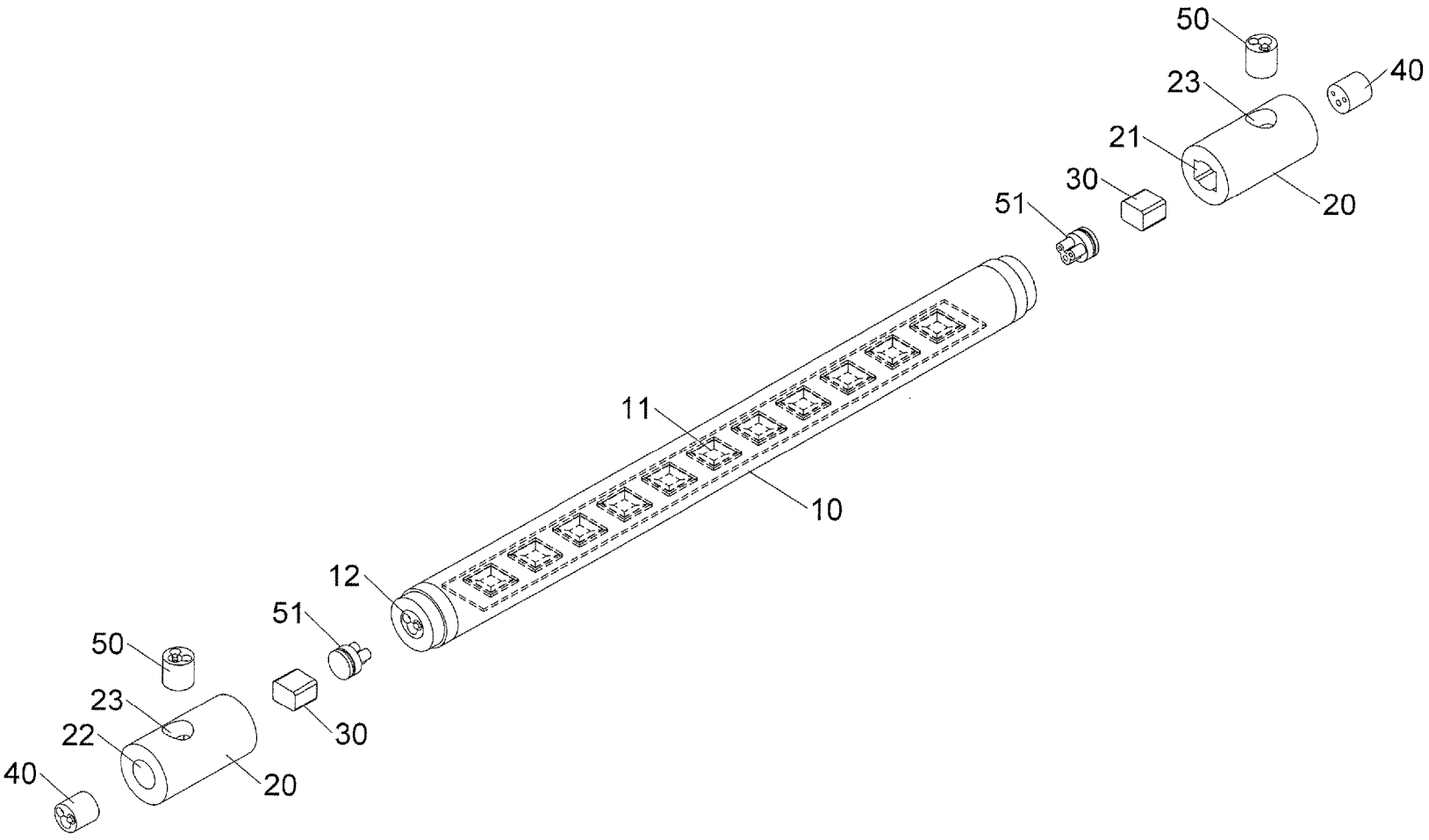
FIG. 6 shows another embodiment of the light assemblies of the present invention.
Figure 7:
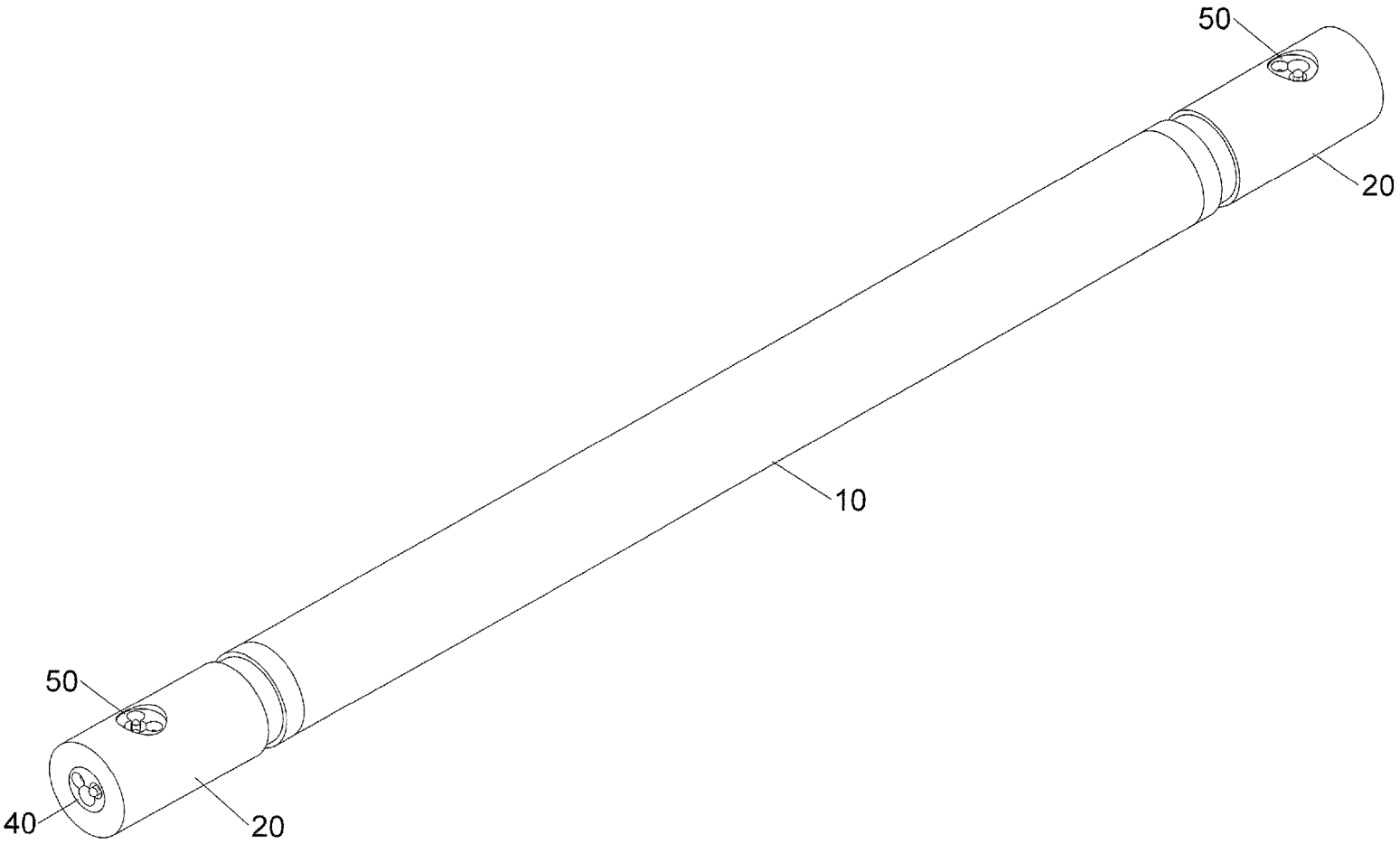
FIG. 7 is a perspective view to show the light assemblies of the present invention as shown in FIG. 6.

As shown in FIGS. 6 and 7, each of the first units 10 has a first plug 12 connected to each of the two ends thereof. The first unit 10, the light members 11 and the first plug 12 can be the conventional ones in the market. The first control member 30 is received in the first room 21. The second units 2 each include a fourth plug 51 which is located in the first room 21. The fourth plug 51 is connected to the first room 21 and partially protrudes beyond the first room 21. The fourth plug 51 is connected to the first plug 12 to connect the second unit 2 to the first unit 10.

Figure 8:
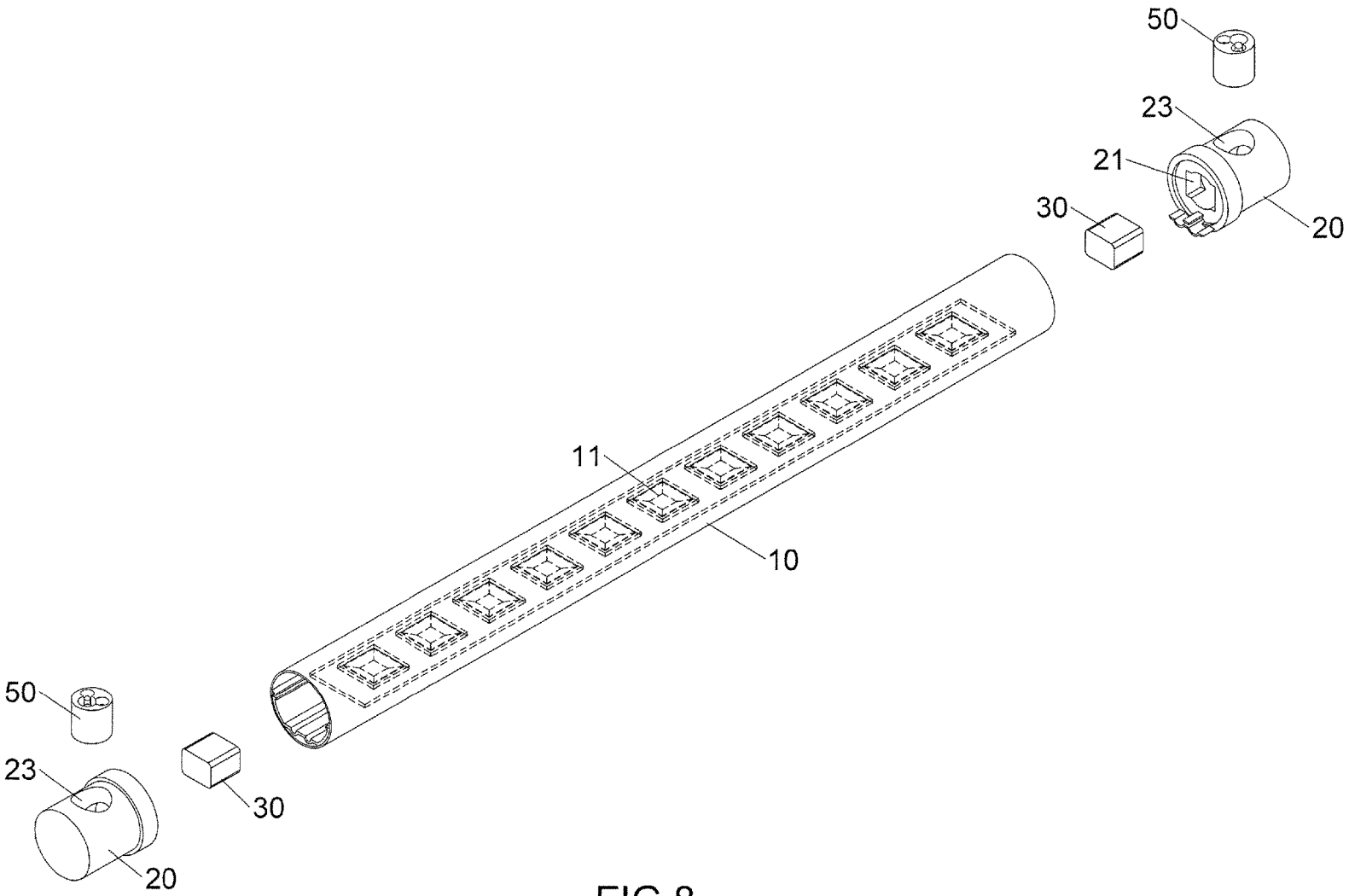
FIG. 8 shows yet another embodiment of the light assemblies of the present invention.
Figure 9:
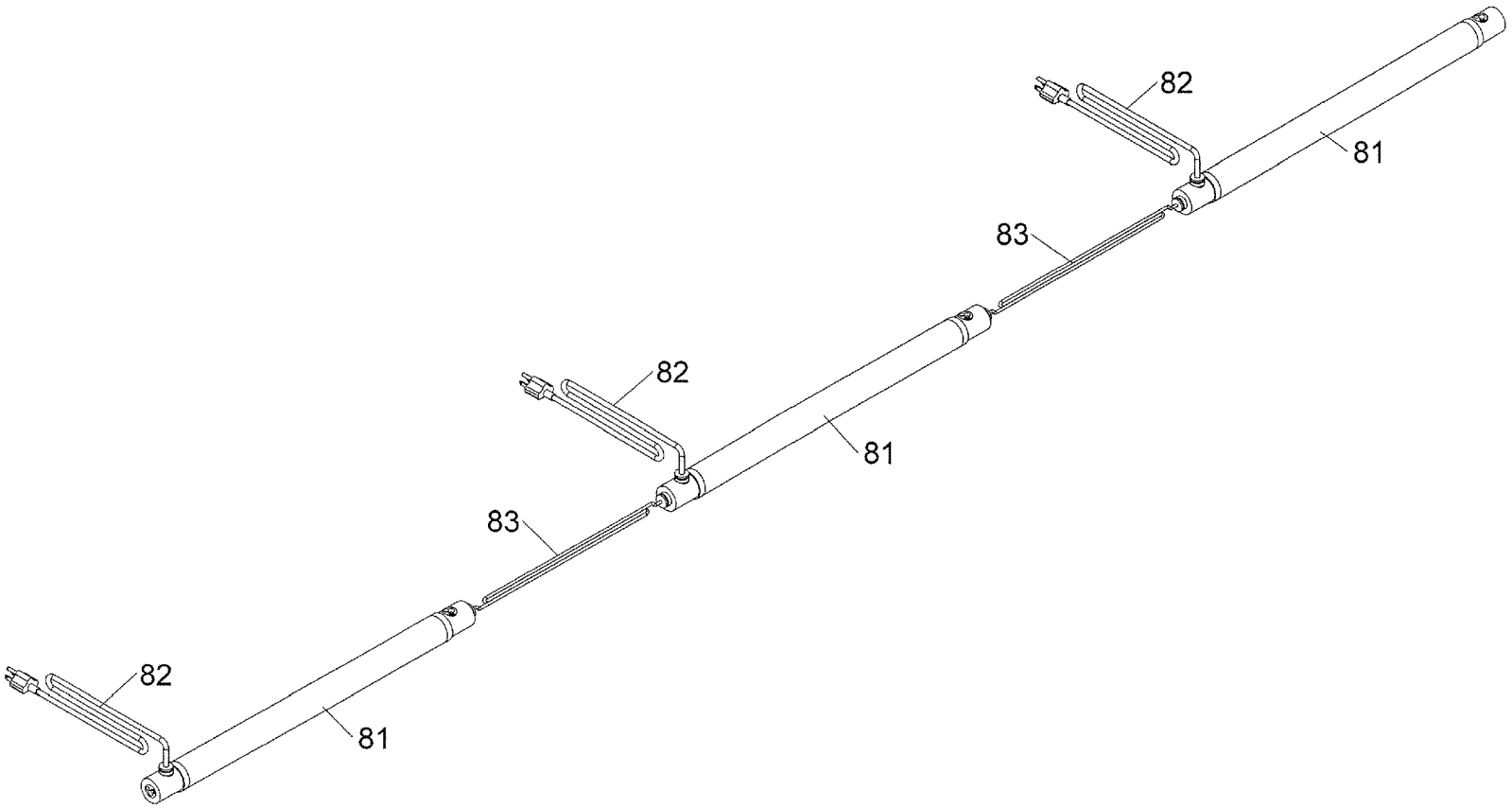
PRIOR ART FIG.9
FIG. 9 shows conventional light assemblies.

As shown in FIG. 8, this embodiment does not have the second plug 40. In other words, there is no second room 22 in the end member 20.

Yet another embodiment shows that the second unit 2 does not have the second and third plugs 40, 50. In other words, the end member 20 does not have the second and third rooms 22, 23.

A further embodiment shows that that is a second control member that controls all of the first control members 30 to activate and de-activate a portion of the first control members 30, such that a portion of the light members 11 are activated, and a portion of the light members 11 are not activated.

The advantages of the present invention are that the first control members 30 can be charged by a power source by wireless way. The multiple first control members 30 are electrically connected to each other wirelessly by using a common frequency so as to control the multiple first units 10. Each of the first control members 30 provides power to the light members 11 so as to turn on or turn off the light members 11 simultaneously. The arrangement of the light assemblies are not restricted by the connection cables.

The first power cable 60 is connected between the third plug 50 and the power source so as to provide electric power to the light members 11. Multiple light assemblies are electrically connected to each other by way of wireless way or by wired way.

A first connection cable 70 is used to connect between two respective second plugs 40 of two light assemblies. That is to say, by using the first connection cable 70, the light assemblies are functioned normally even if the first control members cannot received the frequency.

The second unit 2 has second and third plugs 40, 50, so that the light assemblies can be electrically connected to each other by wireless way or by wired way.

Each of the first units 10 has a first plug 12 connected to each of the two ends thereof. The first unit 10, the light members 11 and the first plug 12 can be the conventional ones in the market. The second units 2 each include a fourth plug 51 which is connected to the first room 21. In other words, the second unit 2 is modularized and connected to the first unit 10 to allow the conventional light assemblies to be connected to each other wirelessly, and charged wirelessly.

While we have shown and described the embodiment in accordance with the present invention, it should be clear to those skilled in the art that further embodiments may be made without departing from the scope of the present invention.

What is claimed is:

1. A light assembly comprising:

multiple first units each having multiple light members received therein, each first unit having two ends;

multiple second units, each of the two ends of each first unit being connected and sealed with one of the multiple second unit;

each second unit including a cylindrical end member, a first control member, multiple plugs, each of the two ends of each first unit being connected with the corresponding second unit by the end member of the corresponding second unit, the end member having a first room and a second room respectively defined in two ends thereof, the first room communicating with the second room, the end member having a third room defined radially therein, the third room communicating with the first room;

the first control member received in the first room of the end member and adapted to be charged by a power source by wireless way, the first control member providing power to the light members and turning on or turning off the light members simultaneously, the first control member electrically connected to the light members by wireless way or wired way;

the second and third rooms receiving one of the multiple plugs respectively; the plugs received in the second and third rooms being female plugs respectively and electrically connected to the first control member by wireless way or by wired way;

each of the first control members being electrically connected to each other wirelessly by using a common frequency so as to control the multiple first units.

2. The light assembly as claimed in claim 1, wherein the first units each are a cylindrical transparent or translucent unit, the light members emit light beams which pass through the first units.

3. The light assembly as claimed in claim 1, wherein at least one seal ring is located between the end member and each of the two ends of the first unit.

4. The light assembly as claimed in claim 1, wherein the first room is a rectangular recess.

5. The light assembly as claimed in claim 1, wherein the second room is a cylindrical recess.

6. The light assembly as claimed in claim 1, wherein an axis of the third room is perpendicular to an axis of the second room, the third room is a cylindrical recess.

7. The light assembly as claimed in claim 1, wherein the first control member partially protrudes beyond the first room of the end member.

8. The light assembly as claimed in claim 1, wherein the common frequency is 433.2 MHZ.

9. The light assembly as claimed in claim 1, wherein a first power cable is connected between the plug in the third room and the power source so as to provide electric power to the light members.

10. The light assembly as claimed in claim 1, wherein a first connection cable is connected between two respective plugs in the second rooms of the second units of two first units.

11. The light assembly as claimed in claim 1, wherein each of the first units has a first plug connected to each of the two ends thereof, one of the multiple plugs is located in the first room and is connected to the first plug to connect the second unit to the first unit.

12. The light assembly as claimed in claim 1 further comprising a second control member that controls all of the first control members to activate and de-activate a portion of the first control members, such that a portion of the light members are activated, and a portion of the light members are not activated.

* * * * *